United States Patent [19]

Underwood

[11] Patent Number: 5,012,537

[45] Date of Patent: May 7, 1991

[54] CLEANING SHIELD

[76] Inventor: Joanna L. Underwood, 550 Knowlton St., Waterloo, Wis. 53594

[21] Appl. No.: 208,270

[22] Filed: Jun. 17, 1988

[51] Int. Cl.[5] ..... E03C 1/186

[52] U.S. Cl. ..... 4/658; 4/634; 4/580; 4/655; 134/175; 312/1; 600/21

[58] Field of Search ..... 4/658, 654, 655, 657, 4/580, 619, 638; 134/200, 175, 176, 104.3, 104.4; 600/21, 22; 128/846, 869, 205.26, 30; 220/85 VR, 85 VS, 87, DIG. 21; 312/1; 604/335, 345

[56] References Cited

U.S. PATENT DOCUMENTS

| | | | |
|---|---|---|---|
| 914,120 | 3/1909 | Demarest | 4/654 |
| 1,355,086 | 10/1920 | Beebe | 4/658 |
| 2,039,490 | 5/1936 | Mikelson | 312/1 |
| 2,970,321 | 2/1961 | Rovell et al. | 4/658 |
| 2,972,353 | 2/1961 | Quest | 134/200 |
| 3,051,163 | 8/1962 | Trexler | 600/21 X |
| 3,547,505 | 7/1969 | Ott et al. | 312/1 |
| 3,806,952 | 4/1974 | Viciulis | 312/1 X |
| 3,971,644 | 7/1976 | Sugarman | 312/1 X |
| 4,630,625 | 12/1986 | Capella et al. | 134/175 X |
| 4,768,534 | 9/1988 | Anderson | 134/200 X |

*Primary Examiner*—Henry J. Recla
*Assistant Examiner*—K. Kupferschmid

[57] ABSTRACT

An apparatus that is particularly useful in a hospital environment when cleaning bedpans and other objects which contain potentially dangerous materials. The apparatus comprises a generally transparent member that is provided with one or more openings for a person's arms, and means for mounting the member so as to locate the transparent member between the basin of the cleaning station and the person.

3 Claims, 2 Drawing Sheets

1A
26
24
40L
46
32
20
30
37
27
28
34
25
35
40R
38
48
22
16
36
12
14
44
1A
42
18
10

40L'
40R'
34
35
32'
36
48
42

24
3A
60L
54
60R
3
3D
3D
51
52
42

3A

80

40L
72
40R
75
78
76
18

82
86
18
86

82'
86'
84'
18
86'

92
40
48
44
99

CLEANING SHIELD

TECHNICAL FIELD

This invention relates, in general, to the subject matter of sanitary equipment and, in particular, to an apparatus which protects hospital workers and others from the hazard of a spray or splash resulting from the cleaning of an object that is contaminated or that contains potentially dangerous material.

BACKGROUND OF THE INVENTION

One task which is carried out on a constant basis in a hospital is the cleaning of bed pans, urine bottles, and sample containers. Usually, the bed pan, for example, is taken by a hospital worker to a nearby washroom where the contents are dumped, flushed, or otherwise discharged down the bowl of a commode. Afterwards the bedpan, or other container, is rinsed with water supplied from a shower-like nozzle mounted at the end of a hose, pipe, or tube which is pivotally or otherwise connected to an adjacent wall, usually the wall at the rear end or the back end of the commode. It often occurs that, during the cleaning and rinsing process, the contents of the bedpan or commode splash or spray upon the hospital worker. The hospital worker, for the most part, wears rubber gloves and an apron, and often a hat or cap. However, rinse water can spray upon the unprotected face. Since the contents of the bedpan may contain blood, or other body fluids, which may have a dangerous material or hazardous product contained therein, the process of cleaning a bedpan presents a potential health risk to the hospital worker. The hazardous material contained within the bedpan, or similar object, can enter into the nose, eyes, mouth, ears, a wound or other opening in the head and chest of the human body, thereby leading to infection.

Heretofore, the task of cleaning a bedpan was considered merely an unpleasant but necessary task and getting splashed in the process was accepted as inevitable. Certainly it was not considered a task which was health or even life threatening. However, evidence has been developed which has called into question the benign nature of such a cleaning task. For example, Acquired Immune Deficiency Syndrome (AIDS) is contracted by the exchange of body fluids, particularly blood and semen. Hepatitis and mononucleosis may also be acquired by contact with another's body fluids. Since in a hospital environment, it is not unusual for a bedpan or a similar container to contain human blood, the routine task of cleaning a bedpan can present a potentially life threatening danger. It is only prudent that steps should be taken to minimize such a danger, especially when one considers the millions of times each day that these cleaning tasks take place.

SUMMARY OF THE INVENTION

Accordingly, it is one basic object of the present invention to present an apparatus which can be easily and conveniently installed in a hospital cleaning station, or similar environment, to reduce the risk of danger resulting from the splashing or spilling of fluids containing potentially contaminated or dangerous material.

It is another object of the invention to disclose an apparatus which can be easily installed and conveniently put into use without overly complicating the cleaning process.

It is yet another object of the invention to disclose a device which can be used during the cleaning process, is simple to install, economical, easy to place into service and, accordingly, a device which is more likely to be used than ignored or bypassed.

In one basic embodiment of the invention, the apparatus comprises an essentially clear, plastic-like, generally rigid member which defines an outer peripheral edge and two opposite, generally parallel faces and means for removably mounting the member at a position relative to a cleaning station. The member has a size that is sufficiently large so as to shield the head and upper torso of a person when the head and upper torso is adjacent to one face of the member, yet has a sufficiently small lateral dimension so as to permit the arms of the person to be placed about the member and position the forearms and hands of the person adjacent to the other face. Thus, when placed in use, the transparent member is positioned relative to the cleaning station, such that it is interposed between the object being cleaned and the head and upper torso of the person doing the cleaning.

The aforementioned objects and other advantages and features of the present invention will become readily apparent from the following detailed description of the invention, from the claims, and from the accompanying drawings.

BRIEF DESCRIPTION OF THE DRAWINGS

FIG. 1 is a pictorial representation of a cleaning station with one embodiment of the present invention installed, while

FIG. 3 is a top plane view and FIG. 3A is a cross-sectional view of another embodiment of the present invention, while

DETAILED DESCRIPTION OF THE PREFERRED EMBODIMENT

Figure 1:
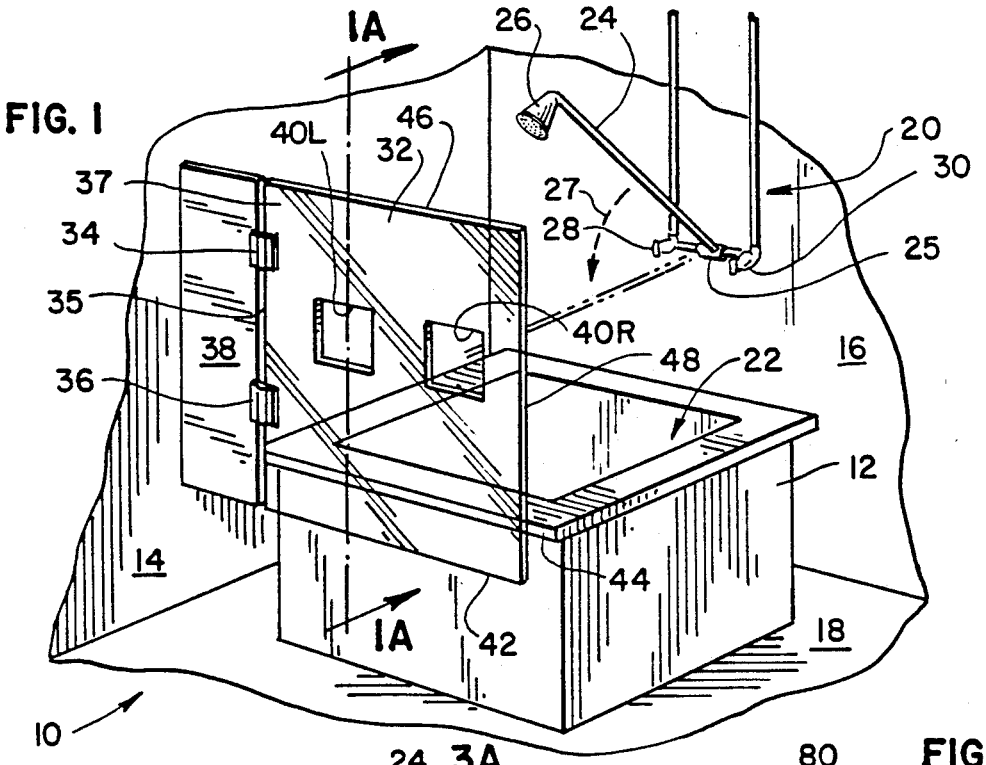

While this invention is susceptible of embodiment in many different forms, there is shown in the drawings and will herein be described in detail several preferred embodiments of the invention. It should be understood, however, that the present disclosure is to be considered as exemplifications of the principles of the invention, and is not intended to limit the invention to the specific embodiments illustrated.

Turning to FIG. 1, there is illustrated a typical hospital cleaning station 10 of the type often used for cleaning bedpans and similar objects. Specifically, the cleaning station 10 comprises a tub-like basin 12 which is located adjacent to one or more walls 14 and 16, and a floor 18. The basin 12 may be floor mounted or wall mounted. In some hospitals, the basin 12 resembles a large commode, often referred to as a "hopper". The basin 12 of the cleaning station 10 is often the bowl of a commode.

In either situation, a source of water 20 is provided to facilitate rinsing and cleaning of objects placed above or within the interior 22 of the basin 12. For example, in the case of a basin 12 formed from the bowl of a commode, the water source comprises a pivotally mounted arm 24 which is joined to a shower-like nozzle 26. The arm 24 is pivotally mounted at one end 25 to a wall 16 and comprises a pipe which supplies water to the nozzle 26. The pipe-like arm is disposed generally upwardly and in a vertical position when it is not in use. When used for cleaning, the arm 24 is moved (see arrow 27) generally horizontal and downwardly toward the interior 22 of the basin 12. Valves 28 and 30 provide cold and hot water to the nozzle head 26 to facilitate cleaning and rinsing.

FIG. 1 illustrates a basic embodiment of the apparatus that forms the present invention. Specifically, the invention comprises a generally transparent member 32 which is hingedly mounted to an adjacent wall 14. The member 32 may be formed from a strong plastic, such as LEXON. The member 32 is shown to be generally rectangular in shape and is disposed generally vertically in front of the basin 12. In this particular embodiment, the member 32 is hingedly mounted by a pair of hinges 34 and 36 to a short partial extension 38 of the adjacent left wall 14.

The transparent member 32 is provided with two hand-holes or apertures 40L and 40R. These apertures are shown to be generally rectangular in shape; however, they may be of any convenient shape. The apertures 40R and 40L should be sufficiently large so that a user's arms 90 may be inserted therein (see FIG. IA). The apertures should be sufficiently vertically spaced and laterally separated that both arms 90 can pass through, and at least one arm can be placed close to the interior 22 of the basin 12. Preferably, the transparent member 32 is located sufficiently close to the source of water 20, that the valves 28 and 30 and the pivotally mounted arm 24 can be easily manipulated by at least one hand. The lower edge 42 of the transparent member is preferably sufficiently low that it extends below the upper edge 44 of the basin 12. Preferably, the upper edge 46 of the transparent member 32 is sufficiently high to cover the top of the user's head 92 when the user's arms 90 are extended through the apertures 40R and 40L. Hinges 34 and 36 allow the transparent member 32 to be swung (see arrow 37) from an "operational" position adjacent the front of the basin 12 to a "stowed" position wherein the member is positioned away from the front of the basin. This allows the basin 12 to be used for other purposes and to be easily serviced or cleaned.

Figure 2A:
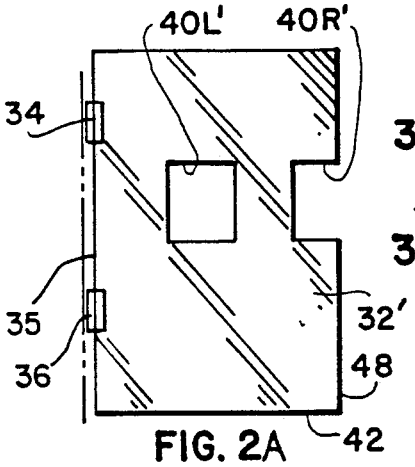
FIGS. 2A and 2B are front elevational views of two other embodiments of the invention shown in FIG. 1.
Figure 2B:
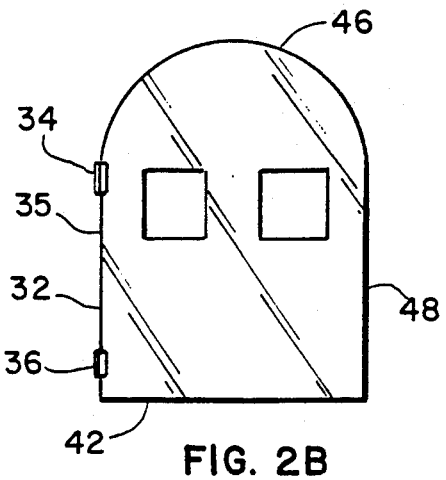

FIG. 2A is a plane view of another embodiment of the invention. In this particular embodiment, the transparent member 32′ has a left-hand aperture 40L which is located completely interior of the member, and a right-hand, three-sided aperture or recess 40R′ which is located along the right-hand edge 48 of the member. Depending upon the location of the basin 12 relative to the surrounding walls 14 and 16, it may be convenient, in some situations, to provide access to the basin by allowing one arm (i.e., the right arm according to orientation of FIG. 2), to reach around the transparent member 32′, rather than reaching through it. FIG. 2B illustrates an embodiment having a rounded top edge 46. Other shapes may be used and may be especially advantageous considering the wide variety of cleaning stations in which the invention may be used.

Figure 3:
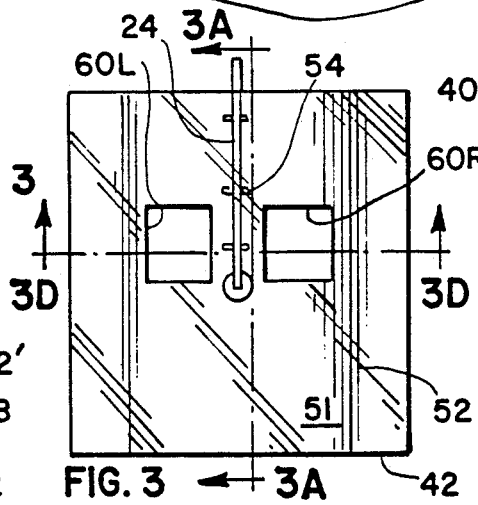
Figure 3A:
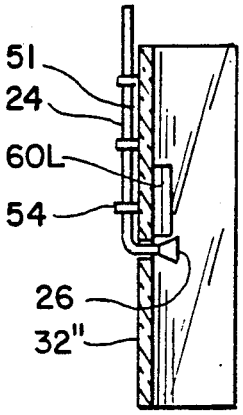

FIG. 3 illustrates still another embodiment of the present invention. In this embodiment of the invention, the transparent member 52 is mounted or attached below the pipe arm 24. The transparent member has two apertures 60L and 60R through which the user's arms may be inserted. Another aperture 60C is provided at the interior of the transparent member 52, such that the nozzle 26 can pass through the transparent member (see FIG. 3A). Thus, that side 50 (i.e., the inside face) of the transparent member 52 facing towards the interior 22 of the basin 12 will receive any splashing or spraying while the other side 51 (i.e., the outside face) has disposed against its surface the pipe-like arm 24. The arm 24 is secured to the outside face 51 of the transparent member 52 by brackets 54. An arrangement whereby the invention fits over the arm 24 so that attachment of the arm is to the inside face of the transparent member 52 would also be considered within the claims of the invention. Such an arrangement, however, is not the preferred embodiment as it would present a greater problem of cleaning the transparent member itself. At this point, it is worth noting that the brackets 54 and the hinges 34 and 36 are preferably made from an easy to clean, corrosion resistant substance, such as plastic or stainless steel.

Figure 3B:
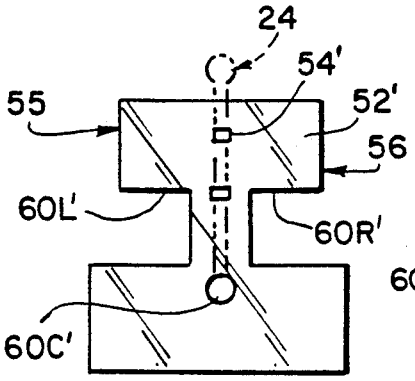
FIGS. 3B, 3C, and 3D are plan views and a cross-sectional view of additional embodiments.

FIG. 3B illustrates a transparent member 52′ similar to that shown in FIG. 3 with the exception that the right-hand and left-hand apertures 60R′ and 60L′ are three sided recesses along the right and left hand edges 55 and 56 of the transparent member 52′.

Figure 3C:
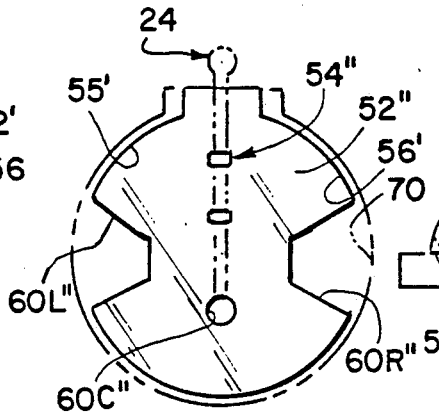

Turning now to FIG. 3C, there is shown yet another embodiment of the present invention. In this embodiment, the transparent member 52″ has a plan view that is generally the same as the top 70 of a commode except that left-hand and right-hand apertures 60L″ and 60R″ as recesses along the left and right-hand edges 55′ and 56′ of the transparent member 52″ are provided.

Figure 3D:
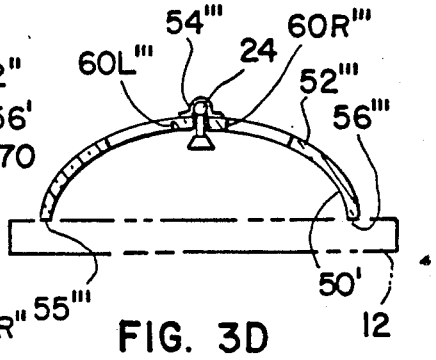

FIG. 3D illustrates a transparent member 52‴ generally similar to that of FIG. 3, with the exception that the interior surface 50‴ is concave toward the interior of the basin 12. This arrangement facilitates the drainage of any splashed or sprayed materials back into the basin.

Figure 4A:
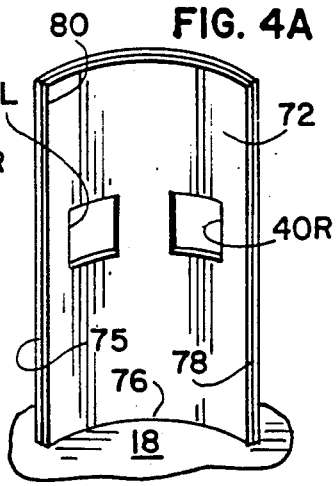
FIGS. 4A, 4B, and 4C are pictorial representations of three more embodiments of the invention.
Figure 4B:
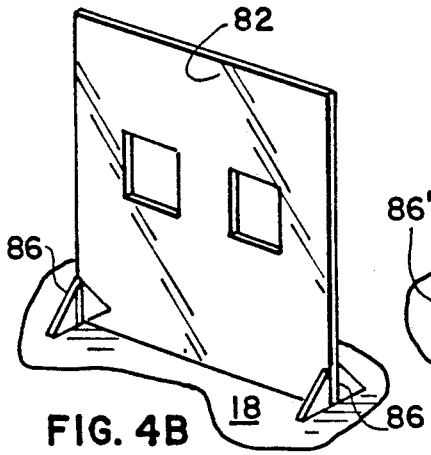
Figure 4C:
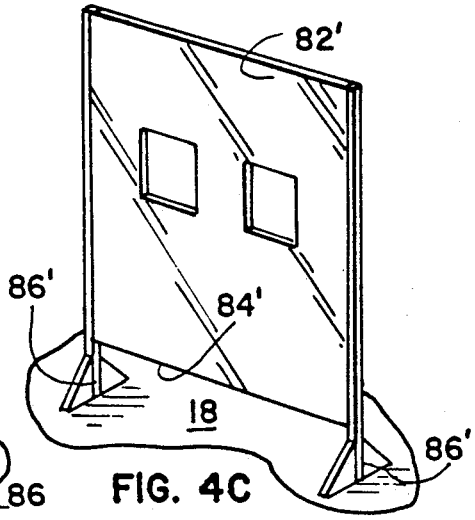

Heretofore, the embodiments illustrated were mounted to or otherwise carried by the walls 14 and 16 of the cleaning station 10 or an object (i.e., the pivotally mounted arm 24) which is carried by one of the walls. FIGS. 4A, 4B, and 4C illustrate transparent members 72, 82 and 82″, respectively, which are supported by the floor 18. In FIG. 4A, the transparent member 72 is not in the form of a flat plane; it is curved and provided with ridges 80 along one or more of its edges 75, 76, and 78. The ridges may be necessary to add to the rigidity of the transparent member, if it is not otherwise supported. In FIG. 4B, the transparent member 82 is generally flat and is supported by a set of feet 86. In FIG. 4C, the feet 86′ hold the lower edge 84′ of the transparent member 82′ at a higher distance from the floor than that shown in FIG. 4B. For purpose of illustration, the feet 86 and 86′ shown in FIGS. 4B and 4C, respectively, are generally flat-like members; rollers or wheels may also be installed to facilitate moving the transparent member 92 from a stowed location or to an operational position, which is located immediately adjacent the basin 12.

Figure 5:
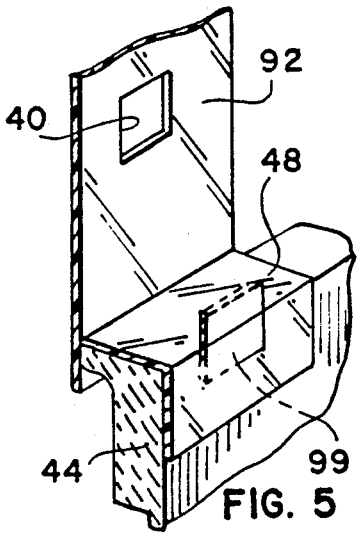
FIG. 5 is a partial, cross-sectional, side elevational view of yet another embodiment of the invention showing the manner in which it is attached to the base of a cleaning station basin.
Figure 1A:
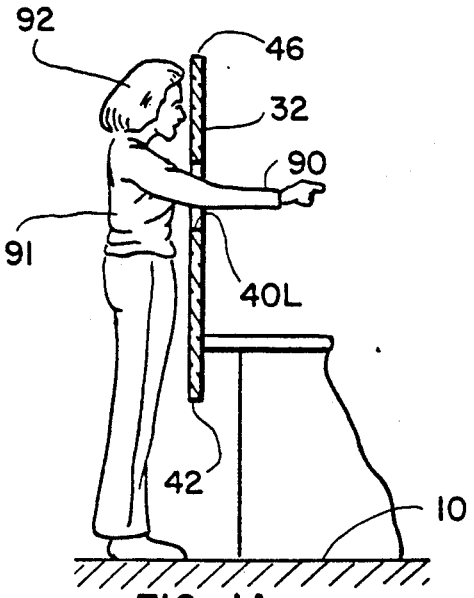
FIG. 1A is a cross-section of the transparent member of FIG. 1 as viewed along line 1A—1A.

FIG. 5 illustrates an embodiment of the invention wherein the transparent member 82 is mounted on the front lip 44 of a commode by means of one or more form fitting brackets 98. Such an embodiment may be particularly useful in a home environment where the cleaning shield can be conveniently installed at the front edge of an ordinary commode. The transparent member may be mounted further inwardly (item 99) to facilitate drainage.

Figure 6:
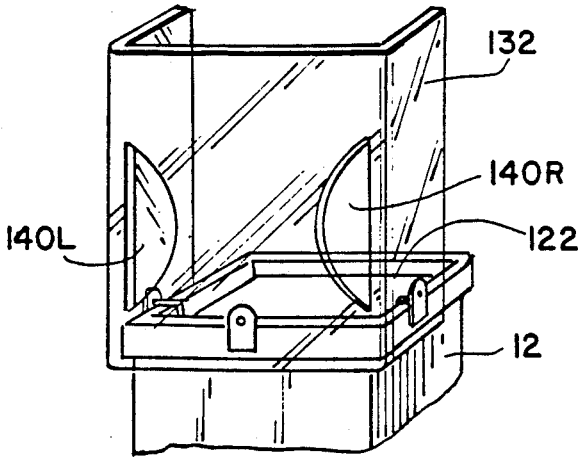
FIG. 6 is a pictorial representation of an additional embodiment.
Figure 6A:
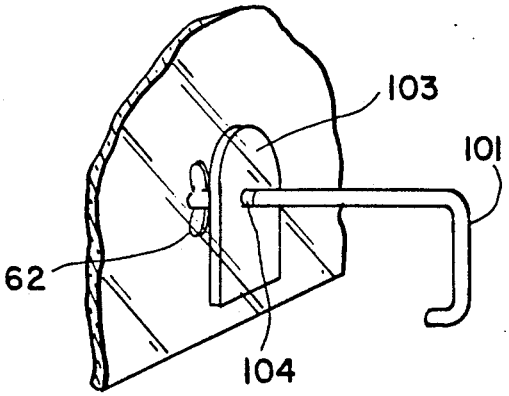
FIG. 6A is a partial detailed view of the screw clamp assembly of the embodiment shown in FIG. 6.

FIG. 6 illustrates yet another embodiment of the invention wherein the transparent member 132 having left and right hand apertures, 140L and 140R, respectively, is mounted on the front and side lips of the commode by means of a screw clamp assembly. Such screw clamp assembly includes a plate 103 on the outside face of the transparent member and a "J" shaped member 101, the crook of which fits about the inside lip of the commode, and the stem of which is threaded at its free end. The threaded free end of the "J" shaped member fits through an opening 104 in the transparent member which opening is contiguous with an opening in the plate 103. A nut, wing nut or the like which is compatible with the threaded end of the member is tightened so as to tighten the screw clamp assembly against the lips of the commode and thus fasten said transparent member to the front and side lips of the commode.

From the foregoing, it will be observed that numerous variations and modifications may be equally effective without departing from the true spirit and scope of the novel concept of the invention. For example, while the transparent member has been shown to be generally rigid and non-self supporting, or mounted from the wall or floor of a cleaning station, the transparent member can be supported from the ceiling and need not necessarily be perfectly rigid. Similarly, although the apertures and recesses have been shown to be generally rectangular in form, they may be in any shape and may be provided with peripheral seals to reduce the potential for liquid to pass from one side of the shield to the other and through the apertures. Thus, it is to be understood that no limitation with respect to the specific apparatus illustrated herein is intended or should be inferred. It is, of course, intended to cover by the appended claims all such modifications as fall within the scope of claims.

I claim:

1. In a hospital washroom or cleaning station including an open-topped commode where items such as bed pans, urine bottles and the like are cleaned, and including a generally vertical wall disposed to the rear or side of said commode, and a source of water which is pivotally mounted to said rear or side wall so as to be moveable between a raised or lowered position, apparatus comprising:

a) a transparent member having at least two open apertures therein, said apertures being spaced adjacent from each other to accommodate the left and right arms of a person, said member having a size that is sufficiently large to shield the head and upper torso of said person; and b) mounting means for removably mounting said member to said pivotally mounted source of water such that said member when attached to said source of water pivots relative to said wall between said raised and said lowered position such that when said member is in said raised position, said commode is open and unshielded, and when said member is in said lowered position, said member is in a generally horizontal plane over said commode, and said commode is open and shielded whereby said person can place both arms through said apertures of said member thereby placing both hands on one side of said member so as to use both hands to clean said items in said commode while said person's head and upper torso remain on the other side of the member so that said person's head and upper torso are shielded from splashing as said items are cleaned.

2. The apparatus of claim 1, wherein said source of water comprises rigid conduit pipe means which has one end pivotally mounted to said wall and which has at its opposite end a nozzle means, and wherein said member has a third aperture positioned so that when said member is attached to said pipe means and in said lowered position, said nozzle means can spray water into said commode.

3. The apparatus of claim 1, wherein said member is curved and concave in the direction of said commode.

* * * * *